US007908769B2

(12) United States Patent
Pellegrini

(10) Patent No.: US 7,908,769 B2
(45) Date of Patent: Mar. 22, 2011

(54) FOOTWEAR WITH A LACE FASTENING

(75) Inventor: Alfred Pellegrini, Montebelluna (IT)

(73) Assignee: Tecnica S.p.A., Giavera del Montello (TV) (IT)

( * ) Notice: Subject to any disclaimer, the term of this patent is extended or adjusted under 35 U.S.C. 154(b) by 1128 days.

(21) Appl. No.: 10/552,565

(22) PCT Filed: Feb. 20, 2004

(86) PCT No.: PCT/EP2004/001684
§ 371 (c)(1),
(2), (4) Date: Oct. 11, 2005

(87) PCT Pub. No.: WO2004/093589
PCT Pub. Date: Nov. 4, 2004

(65) Prior Publication Data

US 2006/0185193 A1 Aug. 24, 2006

(30) Foreign Application Priority Data

Apr. 24, 2003 (IT) ..... PD2003A0083

(51) Int. Cl.
*A43C 1/00* (2006.01)

(52) U.S. Cl. ..... 36/50.1; 36/50.5; 24/712.1

(58) Field of Classification Search ..... 36/50.1, 36/50.5; D2/935, 944, 978; 24/712.1, 712.5, 24/713.6
See application file for complete search history.

(56) References Cited

U.S. PATENT DOCUMENTS

| | | | | |
|---|---|---|---|---|
| 1,504,157 | A * | 8/1924 | Sowers | 24/712 |
| 3,837,098 | A * | 9/1974 | Rathmell | 36/99 |
| 3,934,346 | A * | 1/1976 | Sasaki et al. | 36/138 |
| 4,755,044 | A * | 7/1988 | Thorn | 351/206 |
| 5,755,044 | A * | 5/1998 | Veylupek | 36/50.1 |
| 6,240,657 | B1 * | 6/2001 | Weber et al. | 36/50.1 |
| 6,249,657 | B1 * | 6/2001 | Kagawa | 399/67 |
| 6,502,329 | B1 * | 1/2003 | Silagy | 36/50.1 |
| 6,775,928 | B2 * | 8/2004 | Grande et al. | 36/50.1 |
| 6,802,439 | B2 * | 10/2004 | Azam et al. | 223/113 |
| 6,941,683 | B2 * | 9/2005 | Freed | 36/50.1 |
| 2003/0041478 | A1 | 3/2003 | Liu | |
| 2003/0051374 | A1 | 3/2003 | Freed | |
| 2004/0078999 | A1 | 4/2004 | Freed | |

FOREIGN PATENT DOCUMENTS

| | | | |
|---|---|---|---|
| EP | 0 723 746 | A | 7/1996 |
| FR | 2 770 379 | A | 5/1999 |
| WO | WO 0035308 | A2 * | 6/2000 |

OTHER PUBLICATIONS

International Search Report dated Jun. 23, 2004 for International Application No. PCT/EP2004/001684.

* cited by examiner

*Primary Examiner* — Mickey Yu
*Assistant Examiner* — Sharon M Prange
(74) *Attorney, Agent, or Firm* — RatnerPrestia

(57) ABSTRACT

Footwear with a lace fastening includes an opening with a first edge and a second edge. The first and second edges are juxtaposed and each edge carries a respective plurality of lacing eyes. At least two laces extend through respective pairs of the lacing eyes. The ends of both of the laces converge on both of the edges of the opening, with at least one end of each lace extending through a respective end lacing eye of the fastening provided on each of the opposite edges.

7 Claims, 4 Drawing Sheets

FOOTWEAR WITH A LACE FASTENING

This application is a U.S. National Phase Application of PCT International Application PCT/EP2004/001684.

TECHNICAL FIELD OF THE INVENTION

The present invention relates to footwear with a lace fastening, and more particularly to footwear with elongated uppers and improved lacing.

BACKGROUND ART

A field of particular interest for the application of the invention is that of sport boots such as snow-boarding, trekking, and skating boots and the like. These types of sport boots have uppers that are quite stiff and elongated and the fastenings of which have to satisfy the conflicting requirements of quick and effective tightening and equally quick and'effective loosening. However, the technical teachings provided by the invention are applicable to footwear of different types with preferred use in boots which require a fairly long fastening and a fairly stiff upper.

Amongst the known advantages of lace fastenings is that of creating a homogeneous closure for the foot along the entire extent of the edges of the access opening of the footwear. However, to achieve this, each of the edges of the footwear must carry a respective plurality of lacing eyes arranged fairly close together. Arranging the lacing eyes close together, however, leads to an increase in the angle formed by the lace as it extends into and out of the eyes, which in turn causes greater friction between the lace and the lacing eyes. For this reason, it is not generally possible to fasten (or, on the other hand, to loosen) the fastening simply by exerting a pull on the ends of the lace, but it is necessary to pull on intermediate portions of the lace in order to distribute the pulling load along the entire fastening. Lacing-eye devices and members of particular shapes and designs have been investigated to minimize the effects of the friction between the lacing eyes and the lace. For example, lacing eyes provided with pulleys, with resin inserts having a low coefficient of friction, or with curved profiles have been produced but, in parallel with possible advantages in terms of the ability of the lace to slide, all these involve other disadvantages. In particular, these special devices are bulky and/or delicate and therefore respond poorly either to the need for strength for heavy uses and/or for use in difficult environmental conditions, or to the more typically decorative requirements of the footwear. Moreover, their efficacy in reducing the above-mentioned friction is only partial, to the extent that it is not normally possible, even with relatively short fastenings, to tighten the footwear simply by pulling on the ends of the laces.

US Patent Publication No. 2003/0034365A1 and U.S. Pat. No. 6,467,195 describe sports footwear with lace fastenings in which the two ends of the lace converge in a grip for preventing soreness of the user's hand during the tightening of the fastening.

US Patent Publication No. 2003/0051374 A1 describes a double-lace fastening in which all of the ends of the laces extend through a single edge of the fastening and converge in a strap which in turn can be fixed releasably to the footwear upper beyond the opposite edge. This fastening is suitable exclusively for shoes with a limited number of lacing eyes since it does not permit a high lacing tension to be exerted on the ends of the laces. It also causes non-homogeneous lacing tensions on the two laces since they follow different paths and are of different lengths. In practice, various shapes of users' feet cause a different length of lace to be engaged in the lacing eyes according to the position occupied along the opening to be closed so that, once the fastening is closed, the free ends of the laces are not necessarily of equal length.

BRIEF SUMMARY OF THE INVENTION

An advantage of the present invention is that of providing footwear the fastening of which is designed structurally and functionally to prevent all of the problems discussed above. These problems are solved by the invention of footwear with a lace fastening having an opening with a first edge and a second edge which are juxtaposed and each of which carries a respective plurality of lacing eyes, and at least two laces extending through respective pairs of the lacing eyes. The ends of both of the laces converge on both of the edges of the opening, with at least one end of each lace extending through a respective end lacing eye of the fastening provided on each of the opposite edges.

BRIEF DESCRIPTION OF THE DRAWINGS

The characteristics and the advantages of the invention will become clearer from the detailed description of a preferred embodiment thereof which is described by way of non-limiting example with reference to the appended drawings.

DETAILED DESCRIPTION OF THE INVENTION

Figure 1:
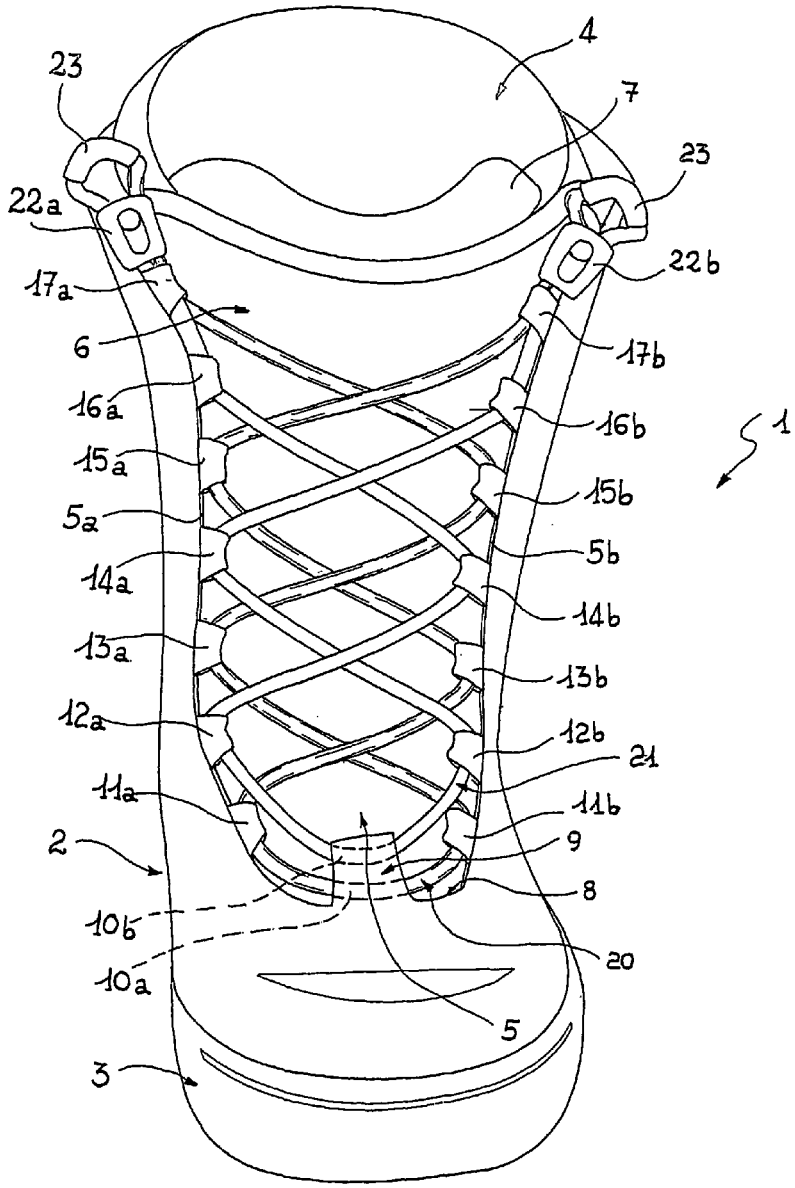
FIG. 1 is a front elevational view of a boot according to the invention with the fastening open.

In the drawings, a boot formed in accordance with the present invention is generally indicated as 1. The boot 1 is of the type used for the sport of snow-boarding but the invention is applicable equally effectively to the production of footwear of other types.

The boot 1 comprises an upper 2 with a sole 3 and an opposed entrance 4 for the fitting-on of the boot. An opening 5 is formed in the upper 2 and has juxtaposed edges indicated 5*a*, 5*b*. A tongue 6 extends from the lower end 8 of the opening 5 as far as the entrance 4 and is optionally provided with padding 7. A lacing eye 9 with two channels 10*a,b* is provided in the opening 5 in the region of its lower end 8.

Respective pluralities of lacing eyes 11*a,b*, 12*a,b*, 13*a,b*, 14*a,b*, 15*a,b*, 16*a,b*, 17*a,b* are fitted in corresponding and facing positions on the respective edges 5*a*, 5*b* (by convention, the lacing eyes on the edge 5*a* are marked with the letter "a" and the lacing eyes fitted on the edge 5*b* with the letter "b"). The lacing eyes 17*a,b* will be referred to below as the end lacing eyes of the fastening.

A first lace and a second lace, indicated 20 and 21, respectively, are engaged in the lacing eyes 9 and in the further lacing eyes 11*a,b* to 17*a,b* in the manner indicated below. The ends of the laces, 20, 21, meaning the portions of the laces which extend beyond the end lacing eyes 17*a,b*, are also engaged in respective locking devices 22*a,b*, for example, of the constricting type.

Figure 2:
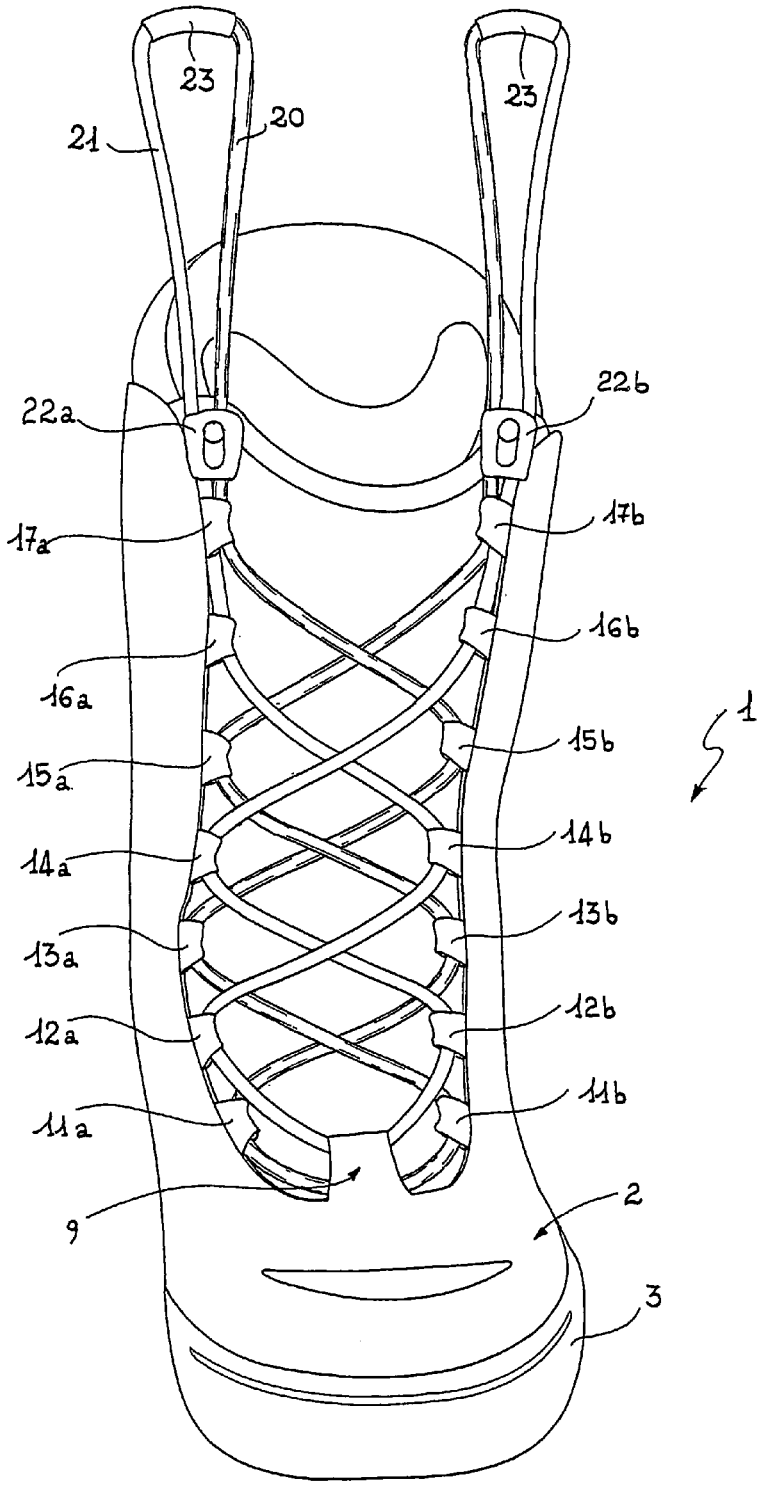
FIG. 2 is a front elevational view of the boot of FIG. 1 during the closure of the fastening.
Figure 3:
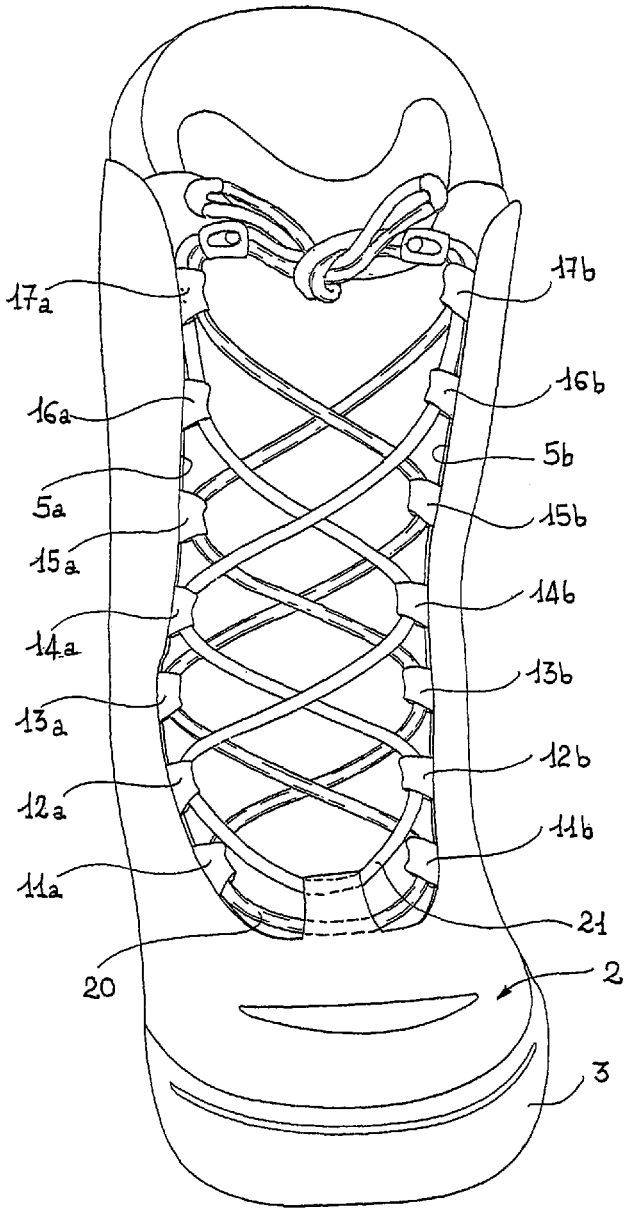
FIG. 3 is a front elevational view of the boot of FIG. 1 with the fastening closed.

The two laces 20, 21 extend through alternate lacing eyes of the two series of lacing eyes in a manner such that, between two lacing eyes of the same edge through which the first lace extends, there is at least one lacing eye of the same edge through which the second lace extends. Both of the laces 20, 21 also extend through respective channels 10*a*, 10*b* of the lacing eye 9 and through the two end lacing eyes 17*a,b* of the fastening. In the embodiment of FIGS. 1 to 3, the first lace 20 is therefore engaged in the lacing eyes 9, 11*a-b*, 13*a-b*, 15*a-b* and 17*a-b*, crossing between the lacing eyes 11-13, 13-15, and 15-17 (*a-b*). The second lace 21 is in turn engaged in the lacing eyes 9, 12*a-b*, 14*a-b*, 16*a-b* and 17*a-b*, crossing between the lacing eyes 12-13 and 14-16 (*a-b*). At the exit from the fastening, a corresponding end of each of the two laces is led through a respective end lacing eye.

Figure 4:
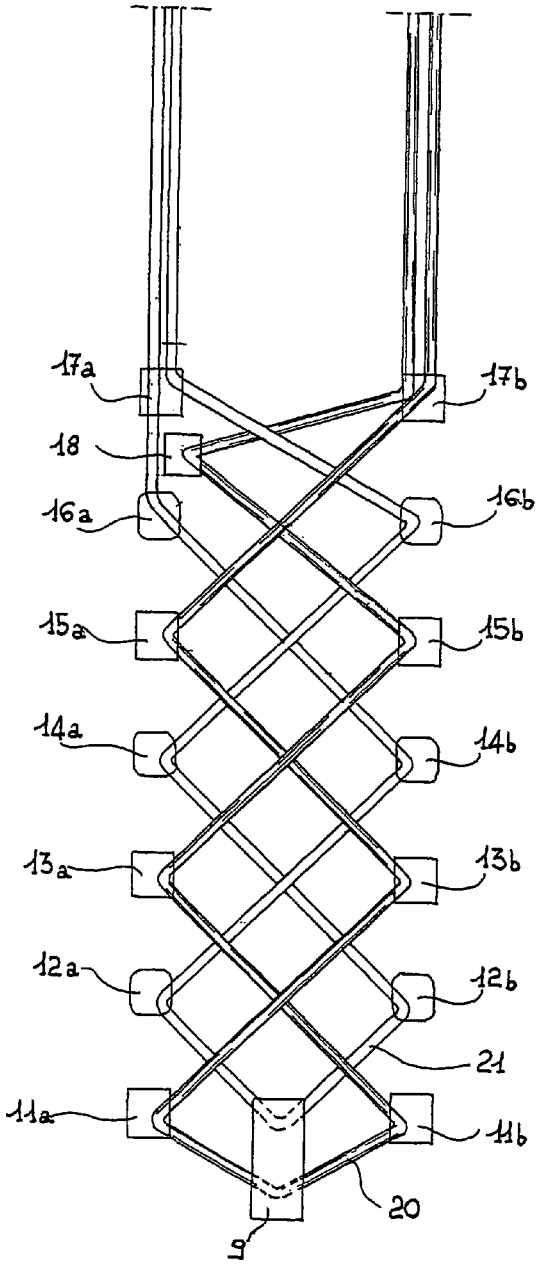
FIG. 4 is a schematic view of a variant of the boot according to the invention with a different threading of the ends of the laces.

In the embodiment of FIG. 4, both of the corresponding ends of the same lace are led through the same end lacing eye 17*a,b* so that both ends of the first lace are led through the end lacing eye 17*a* and both of the ends of the second lace are led through the opposite end lacing eye 17*b*. In this second embodiment, it is necessary to provide a further return lacing eye 18 between the lacing eyes 16 and 17.

Since the portions of each lace engage alternate lacing eyes, for a given "closeness" of the lacing eyes, a smaller angle is formed where the lace extends into and out of the respective lacing eye, resulting in less friction between the laces 20, 21 and the lacing eyes.

The sliding of the laces through the lacing eyes is thus considerably facilitated without, however, prejudicing the uniformity of the fastening tension. This characteristic, together with the fact that the lace tensioning function is distributed over two separate laces and is consequently halved in comparison with conventional fastenings, makes it possible to close the entire fastening simply by exerting a pull on the ends of the laces, without distributing the tightening load manually over intermediate portions of the fastening (that is, without "pulling" the intermediate loops of the laces manually). Since corresponding ends of the two laces converge on opposite edges of the opening 5, the laces can be tensioned independently of the shape of the foot, or of the extent of the opening 5. Moreover, the fastening can be closed to the desired tension in a pulsed manner, that is, by firstly exerting a greater tension on one pair of ends of the laces, for example, those converging on the right-hand edge of the upper and then a corresponding greater tension on the other pair of ends converging on the left-hand edge, alternating the pulls applied and overcoming the friction to the best possible extent.

According to another characteristic of the invention, the free ends of the laces 20, 21 are joined together at the ends to form a closed loop in which the joined ends of the laces form respective grips 23 for facilitating the pulling and tightening of the fastening. This arrangement enables the fastening to be closed even when wearing gloves and in any case by exerting a more effective pull without painfully stressing the fingers, as shown in FIG. 2.

Moreover, with the boot thus designed, there is no longer any need to close the fastening progressively so that the use of open (generally hook-shaped) lacing eyes is superfluous. Since closed lacing eyes can be used (in the embodiment shown lacing eyes of the type with a tape loop sewn to the upper are shown) the laces remain engaged therein even when the fastening is loosened which makes it possible to wear the boot and walk in it with the laces fully loosened, without the free ends hampering movement.

Although, on the one hand, to fasten the footwear, it suffices to exert a tension on the ends of the laces by means of the grips 23 and to lock the constricting locking devices, on the other hand, the operation to loosen the footwear is just as quick and easy and requires purely loosening of the constricting locking devices in order for the lace to slide through the lacing eyes with little friction, reducing the fastening load.

Finally, to prevent undesired loosening of the fastened boot and to prevent the hindrance due to the free ends of the laces, when the fastening is tightened, the two ends can be knotted together as shown in FIG. 3.

The boot may be equipped with two or more laces, arranged with different alternating arrangements in the lacing eyes. Moreover, the constricting locking devices may be fixed to the upper or may be free relative thereto.

The invention claimed is:

1. Footwear with a lace fastening comprising:

an opening with a first edge and a second edge which are juxtaposed and each of the first and second edges carries a respective plurality of lacing eyes;

at least a first lace and a second lace extending through respective pairs of the lacing eyes;

wherein the first and the second laces are led through alternating lacing eyes of the respective pluralities of lacing eyes in a manner such that:

between two consecutive lacing eyes of the first edge through which the first lace extends, there is at least one lacing eye of the first edge through which the second lace extends;

between two consecutive lacing eyes of the second edge through which the first lace extends, there is at least one lacing eye of the second edge through which the second lace extends;

between two consecutive lacing eyes of the first edge through which the second lace extends, there is at least one lacing eye of the first edge through which the first lace extends;

between the two consecutive lacing eyes of the second edge through which the second lace extends, there is at least one lacing eye of the second edge through which the first lace extends;

and such that:

between two consecutive lacing eyes of the first edge through which the first lace extends, the first lace extends through only one lacing eye of the second edge;

between two consecutive lacing eyes of the second edge through which the first lace extends, the first lace extends through only one lacing eye of the first edge;

between two consecutive lacing eyes of the first edge through which the second lace extends, the second lace extends through only one lacing eye of the second edge;

between two consecutive lacing eyes of the second edge through which the second lace extends the second lace extends through only one lacing eye of the first edge;

the first lace crossing between two consecutive lacing eyes of the first edge through which it extends and between two consecutive lacing eyes of the second edge through which it extends, and the second lace crossing between two consecutive lacing eyes of the first edge through which it extends and between two consecutive lacing eyes of the second edge through which it extends;

and wherein the ends of both of the first and second laces converge on both of the first and second edges of the opening, with at least one end of the first and second laces extending through a respective end lacing eye of the fastening provided on each of the first and second edges, and wherein the corresponding ends of each lace converge in respective and separate grips.

2. The footwear according to claim 1 in which the lacing eyes are of the closed-eye type.

3. The footwear according to claim 1 in which means are provided for locking the laces.

4. The footwear according to claim 3 in which the locking means are of the constricting type.

5. The footwear according to claim 4 in which the locking means are provided in the region of the respective end lacing eyes.

6. The footwear according to claim 3 in which the locking means are provided in the region of the respective end lacing eyes.

7. The footwear according to claim 3 in which the locking means are active independently on each pair of the respective ends of laces converging in one of said respective and separate grips.

* * * * *